US012638221B2

(12) United States Patent
Minami et al.

(10) Patent No.: US 12,638,221 B2
(45) Date of Patent: May 26, 2026

(54) REFRIGERANT LEAKAGE MANAGEMENT SYSTEM

(71) Applicant: DAIKIN INDUSTRIES, LTD., Osaka (JP)

(72) Inventors: Junya Minami, Osaka (JP); Yasushi Hori, Osaka (JP); Shinya Matsuoka, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 127 days.

(21) Appl. No.: 18/514,507

(22) Filed: Nov. 20, 2023

(65) Prior Publication Data

US 2024/0085076 A1 Mar. 14, 2024

Related U.S. Application Data

(63) Continuation of application No. PCT/JP2022/020641, filed on May 18, 2022.

(30) Foreign Application Priority Data

May 21, 2021 (JP) ..... 2021-086544

(51) Int. Cl.
*F25B 49/02* (2006.01)

(52) U.S. Cl.
CPC ..... *F25B 49/02* (2013.01); *F25B 2500/222* (2013.01)

(58) Field of Classification Search
CPC ..... F24F 11/36; F25B 49/02; F25B 2500/222
See application file for complete search history.

(56) References Cited

U.S. PATENT DOCUMENTS 6,701,722 B1 * 3/2004 Seo ..... F25B 13/00 62/77
2015/0136379 A1 * 5/2015 Takeda ..... F24F 11/70 165/266
2016/0265803 A1 * 9/2016 Mori ..... F24F 11/526
2018/0051922 A1 2/2018 Ochiai et al.

FOREIGN PATENT DOCUMENTS

EP 3 819 564 A1 5/2021
JP 2009-270733 A 11/2009
JP 2012-242034 A 12/2012
(Continued)

OTHER PUBLICATIONS

RU 2571025 (English translation) (Year: 2015).*
(Continued)

*Primary Examiner* — Jonathan Bradford
(74) *Attorney, Agent, or Firm* — Birch, Stewart, Kolasch & Birch, LLP

(57) ABSTRACT

A refrigerant leakage management system includes a timer and a controller. The timer counts a non-operating period of a refrigeration cycle device. The controller determines whether or not the non-operating period of the refrigeration cycle device exceeds a predetermined first period. Upon determining that the non-operating period of the refrigeration cycle device exceeds the first period, the controller brings the refrigeration cycle device into operation or notifies an administrator of the refrigeration cycle device.

16 Claims, 5 Drawing Sheets

(56) References Cited

FOREIGN PATENT DOCUMENTS

| | | | |
|---|---|---|---|
| JP | 2020-133471 | A | 8/2020 |
| JP | 2021-55956 | A | 4/2021 |
| KR | 10-2014-0046678 | A | 4/2014 |
| WO | WO 2016/174767 | A1 | 11/2016 |
| WO | WO 2020/008625 | A1 | 1/2020 |

OTHER PUBLICATIONS

International Preliminary Report on Patentability and English translation of the Written Opinion of the International Searching Authority for International Application No. PCT/JP2022/020641, dated Nov. 30, 2023.
Extended European Search Report for European Application No. 22804709.8, dated Nov. 6, 2024.
International Search Report (PCT/ISA/210) for PCT/JP2022/020641 mailed on Jun. 28, 2022.

* cited by examiner

REFRIGERANT LEAKAGE MANAGEMENT SYSTEM

CROSS REFERENCE TO RELATED APPLICATIONS

This application is a Continuation of PCT International Application No. PCT/JP2022/020641, filed on May 18, 2022, which claims priority under 35 U.S.C. § 119(a) to Patent Application No. JP 2021-086544, filed in Japan on May 21, 2021, all of which are hereby expressly incorporated by reference into the present application.

TECHNICAL FIELD

The present disclosure relates to a refrigerant leakage management system.

BACKGROUND ART

Conventionally, as disclosed in Patent Literature 1 (JP 2021-055956 A), there has been known a device that determines the presence or absence of refrigerant leakage by acquiring data relating to a refrigeration cycle device during operation.

SUMMARY

A refrigerant leakage management system according to a first aspect includes a timer and a control unit. The timer counts a non-operating period of a refrigeration cycle device. The control unit determines whether or not the non-operating period of the refrigeration cycle device exceeds a predetermined first period. Upon determining that the non-operating period of the refrigeration cycle device exceeds the first period, the control unit brings the refrigeration cycle device into operation or notifies an administrator of the refrigeration cycle device.

DESCRIPTION OF EMBODIMENTS

Hereinafter, a refrigerant leakage management system 1 according to the present disclosure will be described with reference to the drawings as appropriate. Hereinafter, however, unnecessarily detailed description may be omitted. For example, detailed descriptions of already well-known matters and duplicate descriptions for substantially the same configurations may be omitted. This is to avoid unnecessary redundancy in the following description and to facilitate the understanding of those skilled in the art.

First Embodiment (1) Overall Configuration

Figure 1:
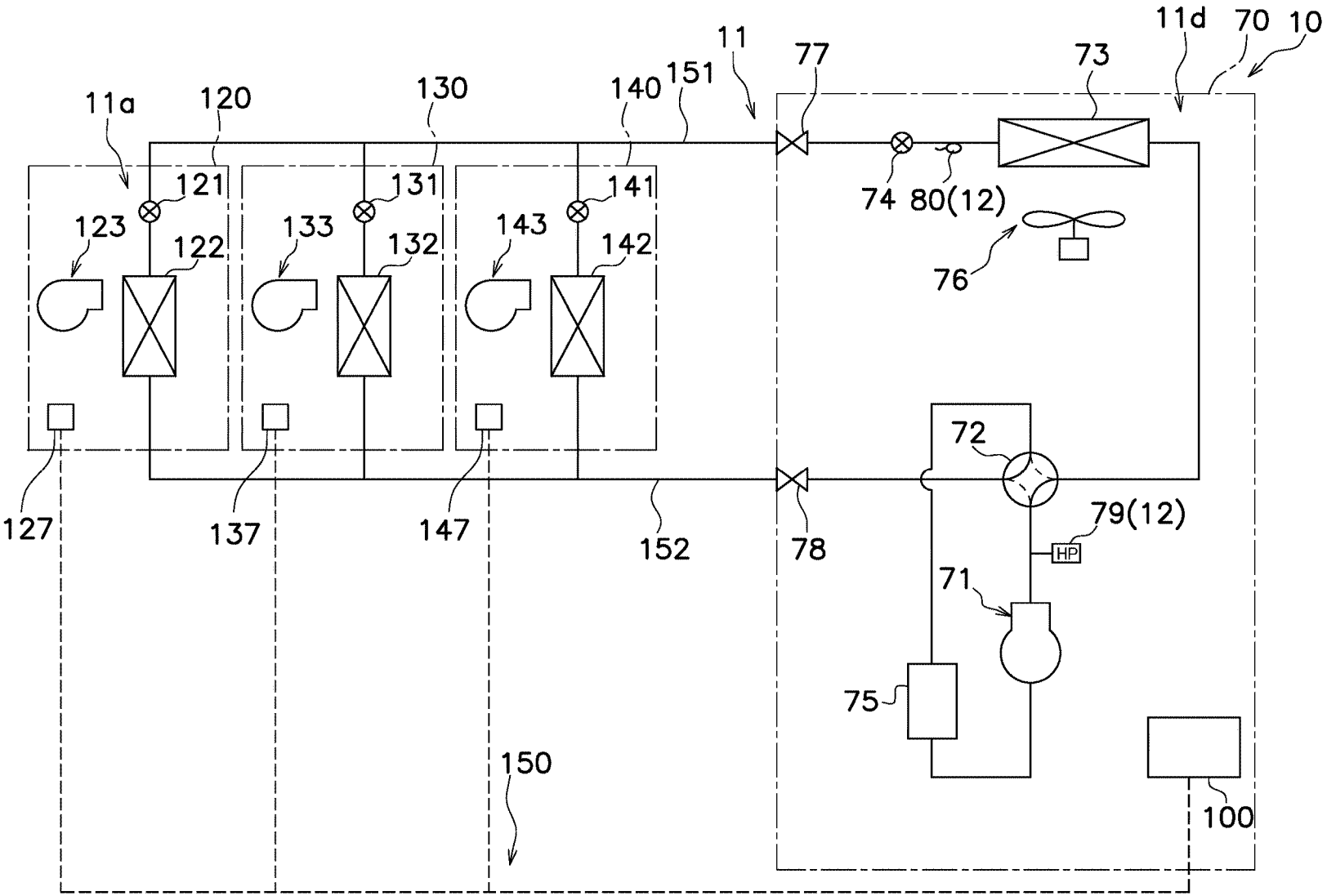
FIG. 1 is a schematic diagram illustrating the overall configuration of a refrigeration cycle device.
Figure 2:
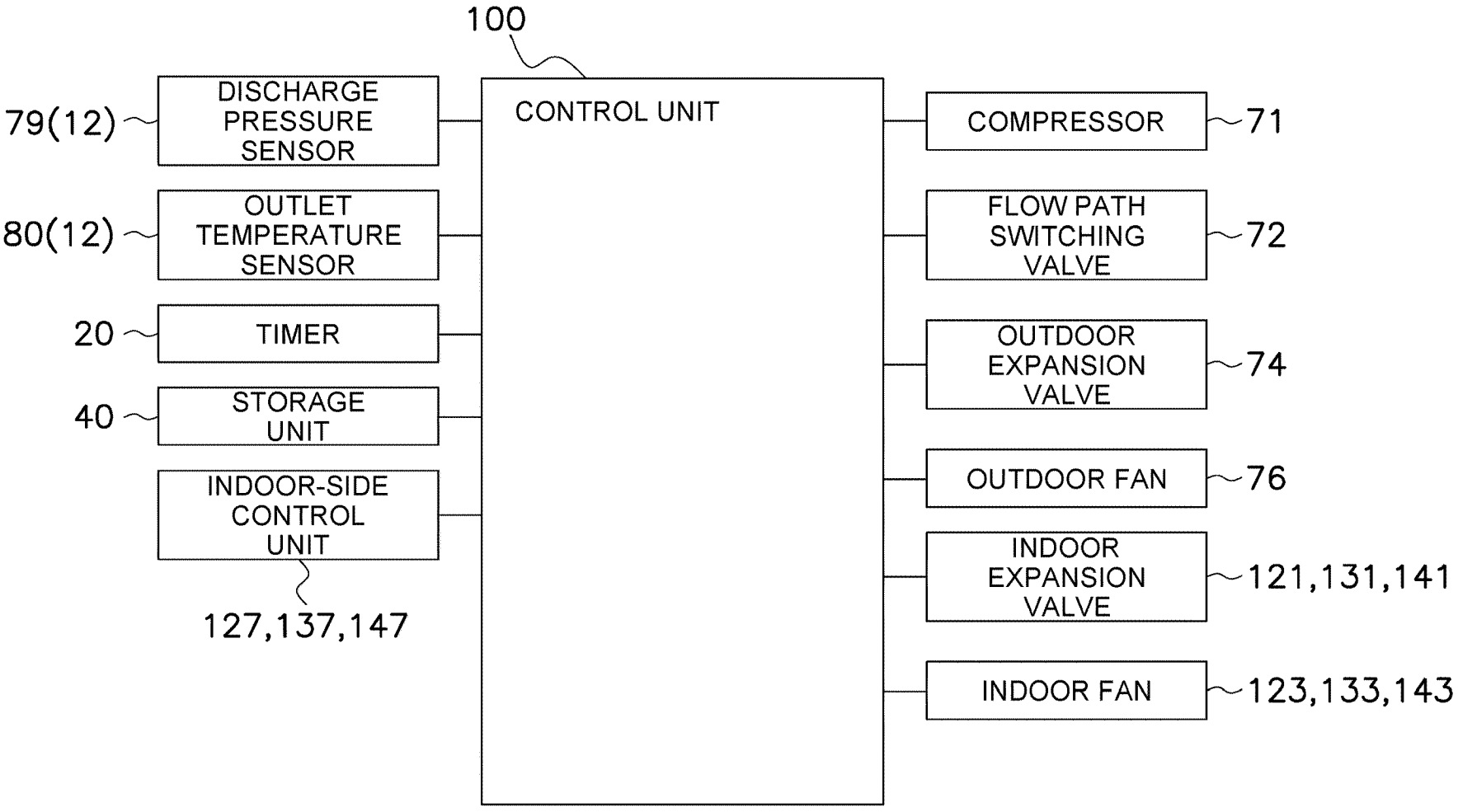
FIG. 2 is a block diagram illustrating the configuration of a control unit.

An outline of the refrigerant leakage management system 1 will be described with reference to FIGS. 1 and 2. FIG. 1 schematically illustrates the overall configuration of a refrigeration cycle device 10 serving as an example of the refrigerant leakage management system 1. FIG. 2 is a block diagram schematically illustrating the configuration of a control unit 100.

As illustrated in FIG. 1, the refrigeration cycle device 10 mainly has a single outdoor unit 70 and a plurality of indoor units 120, 130, and 140 connected to the outdoor unit 70. In addition, the outdoor unit 70 and the indoor units 120, 130, and 140 are connected via a liquid-refrigerant connection pipe 151 and a gas-refrigerant connection pipe 152 to constitute a refrigerant circuit 11.

(2-1) Indoor Unit

The configurations of the indoor units 120, 130, and 140 will be described. In the present embodiment, the configuration of the indoor unit 120 is substantially the same as the configurations of the indoor units 130 and 140. Therefore, only the configuration of the indoor unit 120 will be described herein, and the configurations of the indoor units 130 and 140 will be denoted with reference numerals in the 130 series and 140 series, respectively, in place of the reference numerals in the 120 series indicating the parts of the indoor unit 120, and the description of the respective parts will be omitted.

The indoor unit 120 is a utilization-side unit that is installed on the ceiling or the like of an indoor space. The indoor unit 120 mainly has an indoor expansion valve 121, an indoor heat exchanger 122, and an indoor fan 123. The indoor unit 120 also includes an indoor-side refrigerant circuit 11*a* that is part of the refrigerant circuit 11.

The indoor expansion valve 121 is an electronic expansion valve connected to the liquid side of the indoor heat exchanger 122, and adjusts the pressure and flow rate of the refrigerant flowing through the indoor-side refrigerant circuit 11*a*. Note that the indoor expansion valve 121 is not limited to an electronic expansion valve, and any mechanism generally used as an expansion mechanism in a refrigeration cycle device may be selected as appropriate.

The indoor heat exchanger 122 exchanges heat between air and refrigerant. The indoor heat exchanger 122 functions as an evaporator for the refrigerant during cooling operation and cools indoor air. In addition, the indoor heat exchanger 122 functions as a condenser for the refrigerant during heating operation and heats indoor air. The indoor heat exchanger 122 according to the present embodiment is, for example, a cross-fin type fin-and-tube heat exchanger including a heat transfer tube and a large number of fins.

The indoor fan 123 is a blower that draws indoor air into a casing (not illustrated) of the indoor unit 120 and supplies the indoor air to the indoor heat exchanger 122. The indoor air heat-exchanged with the refrigerant flowing through the indoor heat exchanger 122 is supplied into the room. As the indoor fan 123, for example, a centrifugal fan, a multiblade fan, or the like can be used.

The indoor unit 120 also has an indoor-side control unit 127 that controls the operation of the parts constituting the indoor unit 120. The indoor-side control unit 127 has a microcomputer, a storage device, and the like provided to control the indoor unit 120, and can communicate control signals with a remote controller (not illustrated) for individually operating the indoor unit 120, and communicate control signals with the outdoor unit 70 through a transmission line 150.

(2-2) Outdoor Unit

The outdoor unit 70 is a heat source unit installed on the rooftop or basement of a building. The outdoor unit 70 constitutes an outdoor-side refrigerant circuit lid that is part of the refrigerant circuit 11. The outdoor unit 70 mainly has a compressor 71, a flow path switching valve 72, an outdoor heat exchanger 73, an outdoor expansion valve 74, an accumulator 75, an outdoor fan 76, a liquid-side shutoff valve 77, a gas-side shutoff valve 78, and a timer 20. Further, the outdoor unit 70 has a storage unit 40 and the control unit 100. Details of the storage unit 40 and the control unit 100 will be described later.

The compressor 71 compresses low-pressure refrigerant in a refrigeration cycle into high pressure refrigerant. Here, as the compressor 71, a compressor having a sealed structure in which a positive displacement compression element (not illustrated), such as a rotary or scroll type, is rotationally driven by a compressor motor (not illustrated) is used. The motor can be controlled in rotational speed by an inverter. The capacity of the compressor 71 is controlled by controlling the rotational speed (operational frequency) of the motor. Note that although FIG. 1 illustrates an example of the outdoor unit 70 having the single compressor 71, the configuration of the compressor 71 is not limited thereto. For example, the outdoor unit 70 may have a plurality of compressors 71 connected in parallel. In addition, if the outdoor unit 70 compresses the refrigerant in multiple stages, the outdoor unit 70 may have the plurality of compressors 71 connected in series.

The flow path switching valve 72 switches the refrigerant flow direction, thereby changing the state of the outdoor heat exchanger 73 between a first state in which the outdoor heat exchanger 73 functions as a condenser and a second state in which the outdoor heat exchanger 73 functions as an evaporator. Note that when the flow path switching valve 72 brings the outdoor heat exchanger 73 into the first state, the indoor heat exchangers 122, 132, and 142 function as evaporators. In addition, when the flow path switching valve 72 brings the outdoor heat exchanger 73 into the second state, the indoor heat exchangers 122, 132, and 142 function as condensers.

The outdoor heat exchanger 73 exchanges heat between air and refrigerant. The outdoor heat exchanger 73 functions as a condenser for the refrigerant during the cooling operation, and functions as an evaporator for the refrigerant during the heating operation. The outdoor heat exchanger 73 has the gas side connected to the flow path switching valve 72 and the liquid side connected to the outdoor expansion valve 74. The outdoor heat exchanger 73 according to the present embodiment is, for example, a cross-fin type fin-and-tube heat exchanger.

The outdoor expansion valve 74 is an electronic expansion valve that adjusts the pressure, flow rate, and the like of the refrigerant flowing in the outdoor-side refrigerant circuit lid. The outdoor expansion valve 74 is disposed upstream of the outdoor heat exchanger 73 in the refrigerant flow direction during the heating operation (here, the outdoor expansion valve 74 is connected to the liquid side of the outdoor heat exchanger 73).

The accumulator 75 is a container having a gas-liquid separation function of separating the inflowing refrigerant into gas refrigerant and liquid refrigerant. The accumulator 75 also has the function of storing excess refrigerant generated in response to, for example, fluctuations in the operating loads of the indoor units 120, 130, and 140. The refrigerant flowing into the accumulator 75 is separated into gas refrigerant and liquid refrigerant, and the gas refrigerant collecting in the upper space flows out to the compressor 71.

The outdoor fan 76 is a blower that draws outdoor air into a casing (not illustrated) of the outdoor unit 70. The outdoor air drawn into the casing exchanges heat with the refrigerant in the outdoor heat exchanger 73, and then is discharged to the outside of the casing. The outdoor fan 76 according to the present embodiment is, for example, a propeller fan.

The liquid-side shutoff valve 77 and the gas-side shutoff valve 78 are provided at connecting ports to external equipment and pipes (specifically, the liquid-refrigerant connection pipe 151 and the gas-refrigerant connection pipe 152). The liquid-side shutoff valve 77 and the gas-side shutoff valve 78 according to the present embodiment are, for example, manually operated valves.

The timer 20 is a clock capable of measuring information relating to the current time or the time elapsed from a certain point of time. The operation of the timer 20 is controlled by the control unit 100. The control unit 100, for example, causes the timer 20 to start counting when the operation of the refrigeration cycle device 10 stops, and resets the count by the timer 20 when the operation of the refrigeration cycle device 10 starts. Thus, the timer 20 can count the non-operating period of the refrigeration cycle device 10. In the present embodiment, the period (non-operating period of the refrigeration cycle device 10) counted by the timer 20 is acquired by the control unit 100. Details will be described later.

In addition, the outdoor unit 70 is provided with various sensors serving as a detection unit 12. Specifically, the outdoor unit 70 is provided with a discharge pressure sensor 79 that detects a discharge pressure Hp of the compressor 71, and an outlet temperature sensor 80 that detects an outlet temperature Tb that is a refrigerant temperature on the outlet side of the outdoor heat exchanger 73. However, the sensors provided in the refrigeration cycle device 10 are not limited to the sensors 79 and 80 described above. The refrigeration cycle device 10 may be provided with one or more sensors capable of detecting, for example, the indoor temperature and humidity, the outdoor temperature and humidity, the suction pressure (evaporation saturation temperature), the suction gas temperature, the discharge gas temperature, the refrigerant temperature on the inlet side of the indoor heat exchanger, the refrigerant temperature on the outlet side of the indoor heat exchanger, the refrigerant temperature on the inlet side of the outdoor heat exchanger, the rotational speed of the compressor 71, and the current value of the compressor 71. In the present embodiment, the detection results detected by the detection unit 12 are acquired by the control unit 100. Details will be described later.

(3) Detailed Configuration of Storage Unit and Control Unit (3-1) Storage Unit

The storage unit 40 is a memory including, for example, a ROM a RAM, and the like. The storage unit 40 pre-stores settings for a first period, a second period, and a third period. In addition, the storage unit 40 stores various kinds of information including programs read by a control calculation device described later, communication protocols used when a first device 61 communicates with other devices, and the like.

(3-1-1) Second Period

For convenience of description, the second period will be described before the first period. During the second period, inspection of the refrigeration cycle device 10 by a method other than manual inspection is allowed. In addition, the second period is defined by a rule. In the present embodiment, the "rule" refers to the laws and regulations or guidelines of each country which stipulate matters related to the inspection of the refrigeration cycle device 10. Here, for example, a case where the second period is defined as three month by the rule will be described.

(3-1-2) First Period

The first period is shorter than the second period. As described above, in the present embodiment, the second period is set to three months. Therefore, the first period is set to, for example, two months and three weeks. Although details will be described later, the control unit 100 according to the present embodiment brings the refrigeration cycle device 10 into operation when the non-operating period of the refrigeration cycle device 10 exceeds the first period.

(3-1-3) Third Period

The third period is shorter than the first period. As described above, in the present embodiment, the first period is set to two months and three weeks. Therefore, the third period is set to, for example, two months and two weeks. Although details will be described later, the control unit 100 according to the present embodiment notifies the administrator of the refrigeration cycle device 10 when the non-operating period of the refrigeration cycle device 10 exceeds the third period.

(3-2) Control Unit

The control unit 100 included in the outdoor unit 70 will be described. The control unit 100 is implemented by, for example, a computer. The control unit 100 controls the operation of various equipment constituting the outdoor unit 70. The control unit 100 has a control calculation device (not illustrated). As the control calculation device, various processors such as a CPU and a GPU can be used. The control calculation device can read various kinds of information and programs stored in the storage unit 40 and perform predetermined calculation processing in accordance with the programs.

The control unit 100 is electrically connected to the compressor 71, the flow path switching valve 72, the outdoor expansion valve 74, the outdoor fan 76, the detection unit 12, and the timer 20 so as to enable the exchange of control signals and information (see FIG. 2). The control unit 100 is also electrically connected to the indoor-side control units 127, 137, and 147 through the transmission line 150 so as to enable the exchange of control signals and information. Thus, the control unit 100 can control the operation of various equipment constituting the outdoor unit 70, on the basis of the various detection results acquired by the detection unit 12 and the commands related to the set temperature and operation mode received by the indoor-side control units 127, 137, and 147 from the remote controller, and the like. To supplement, the control unit 100 can switch the states of the indoor unit between a thermo-on state and a thermo-off state on the basis of the degree of divergence between the set temperature set by the user of the indoor unit (for example, the indoor unit 120) through the remote controller and the air temperature of the space in which the indoor unit is installed. The thermo-on state refers to a state in which the refrigerant flows in the indoor heat exchanger (for example, indoor heat exchanger 122) and sufficient heat exchange is performed between the refrigerant and indoor air. The thermo-off state refers to a state in which no refrigerant flows in the indoor heat exchanger and there is substantially no heat exchange between the refrigerant and indoor air.

In addition, the control unit 100 can exert the function of controlling the refrigeration cycle device 10 in accordance with the non-operating period of the refrigeration cycle device 10 by reading the programs stored in the storage unit 40. Details will be described below.

Note that the configuration of the control unit 100 is not limited to the above example. For example, the configuration of the control unit 100 may be implemented by hardware such as a logic circuit. Alternatively, the configuration of the control unit 100 may be implemented by a combination of hardware and software.

(3-2-1)

First, the control unit 100 acquires information relating to the refrigeration cycle device 10. Specifically, the control unit 100 acquires information relating to the non-operating period of the refrigeration cycle device 10 counted by the timer 20. Note that in the present embodiment, the information relating to the non-operating period of the refrigeration cycle device 10 is preferably acquired at any time. In addition, the control unit 100 may acquire the detection results detected by the detection unit 12, and information relating to the power on/off of the refrigeration cycle device 10, thermo-on/off, operation mode, set temperature, and the like. The information acquired by the control unit 100 is stored in a predetermined storage area of the storage unit 40.

After acquiring the information relating to the non-operating period of the refrigeration cycle device 10, the control unit 100 determines whether or not the non-operating period of the refrigeration cycle device 10 exceeds the third period. If the non-operating period of the refrigeration cycle device 10 exceeds the third period, the control unit 100 notifies the administrator of the refrigeration cycle device 10. For example, the control unit 100 transmits, to a terminal or the like owned by the administrator, a message indicating that the non-operating period of the refrigeration cycle device 10 has exceeded the third period. At this time, preferably, the control unit 100 simultaneously transmits a message indicating that the refrigeration cycle device 10 needs to be manually inspected if the non-operating period of the refrigeration cycle device 10 exceeds the second period.

Next, the control unit 100 again acquires information relating to the refrigeration cycle device 10. At this time, the information acquired by the control unit 100 includes information relating to the power on/off of the refrigeration cycle device 10 and information relating to the non-operating period of the refrigeration cycle device 10 counted by the timer 20. Thus, the control unit 100 can confirm whether or not the operation of the refrigeration cycle device 10 has been started. If the operation of the refrigeration cycle device 10 has been started, the control unit 100 resets the count of the timer 20. Meanwhile, there may be a case where the operation of the refrigeration cycle device 10 is not started.

If the operation of the refrigeration cycle device 10 has not been started, the control unit 100 determines whether or not the non-operating period of the refrigeration cycle device 10 exceeds the first period. If the non-operating period of the refrigeration cycle device 10 exceeds the first period, the control unit 100 notifies the administrator of the refrigeration cycle device 10. For example, the control unit 100 transmits, to a terminal or the like owned by the administrator, a message indicating that the refrigeration cycle device 10 will now be forcibly operated. The control unit 100 starts the operation of the refrigeration cycle device 10 at a predetermined time (for example, 10 minutes) after the transmission of the above message. Here, for example, the control unit 100 causes the refrigeration cycle device 10 to operate in a cooling operation mode for about 5 minutes. At this time, the control unit 100 resets the count by the timer 20.

The control unit 100, which has started the cooling operation of the refrigeration cycle device 10, can exert the function of determining the presence or absence of refrigerant leakage in the refrigerant circuit 11 by reading the programs stored in the storage unit 40. Details will be described below.

(3-2-2)

The control unit 100, which has started the cooling operation of the refrigeration cycle device 10, determines the presence or absence of refrigerant leakage in the refrigerant circuit 11 on the basis of, for example, the degree of subcooling of the refrigerant on the outlet side of the outdoor heat exchanger 73. The degree of subcooling of the refrigerant on the outlet side of the outdoor heat exchanger 73 is the temperature difference between a condensation temperature Tc and the outlet temperature Tb of the condenser (here, outdoor heat exchanger 73), and is represented by Tc−Tb. In the present embodiment, the outlet temperature Tb of the condenser (outdoor heat exchanger 73) can be acquired from the outlet temperature sensor 80. In addition, in the present embodiment, the condensation temperature Tc can be calculated from the discharge pressure Hp detected by the discharge pressure sensor 79.

After calculating the degree of subcooling from the condensation temperature Tc and the outlet temperature Tb, the control unit 100 acquires a reference value for the degree of subcooling through the detection unit 12. The reference value can be predicted from, for example, the amount of refrigerant in the refrigerant circuit 11, the outdoor air temperature, the rotational speed of the compressor 71, the current value of the compressor 71, and the like. The control unit 100, which has predicted the reference value for the degree of subcooling, calculates the difference between the calculated degree of subcooling and the predicted reference value. If the difference between the calculated degree of subcooling and the predicted reference value exceeds a predetermined value stored in advance in the storage unit 40, the control unit 100 determines that the refrigerant is leaking in the refrigerant circuit 11. Meanwhile, if the difference between the calculated degree of subcooling and the predicted reference value is equal to or less than the predetermined value, the control unit 100 determines that no refrigerant is leaking in the refrigerant circuit 11.

Note that the refrigerant leakage determination method by the control unit 100 is not limited to the above example. Therefore, for example, the control unit 100 may determine the presence or absence of the refrigerant leak using the indoor temperature and humidity, the outdoor temperature and humidity, the suction pressure (evaporation saturation temperature), the suction gas temperature, the discharge gas temperature, the refrigerant temperature on the inlet side of the indoor heat exchanger, the refrigerant temperature on the outlet side of the indoor heat exchanger, the refrigerant temperature on the inlet side of the outdoor heat exchanger, the rotational speed of the compressor 71, the current value of the compressor 71, and the like.

Alternatively, some or all of the functions of the control unit 100 described above may be implemented by the indoor-side control units 127, 137, and 147, a control device (not illustrated), or the like.

(3-2-3) Overall Operation of Control Unit

Figure 3:
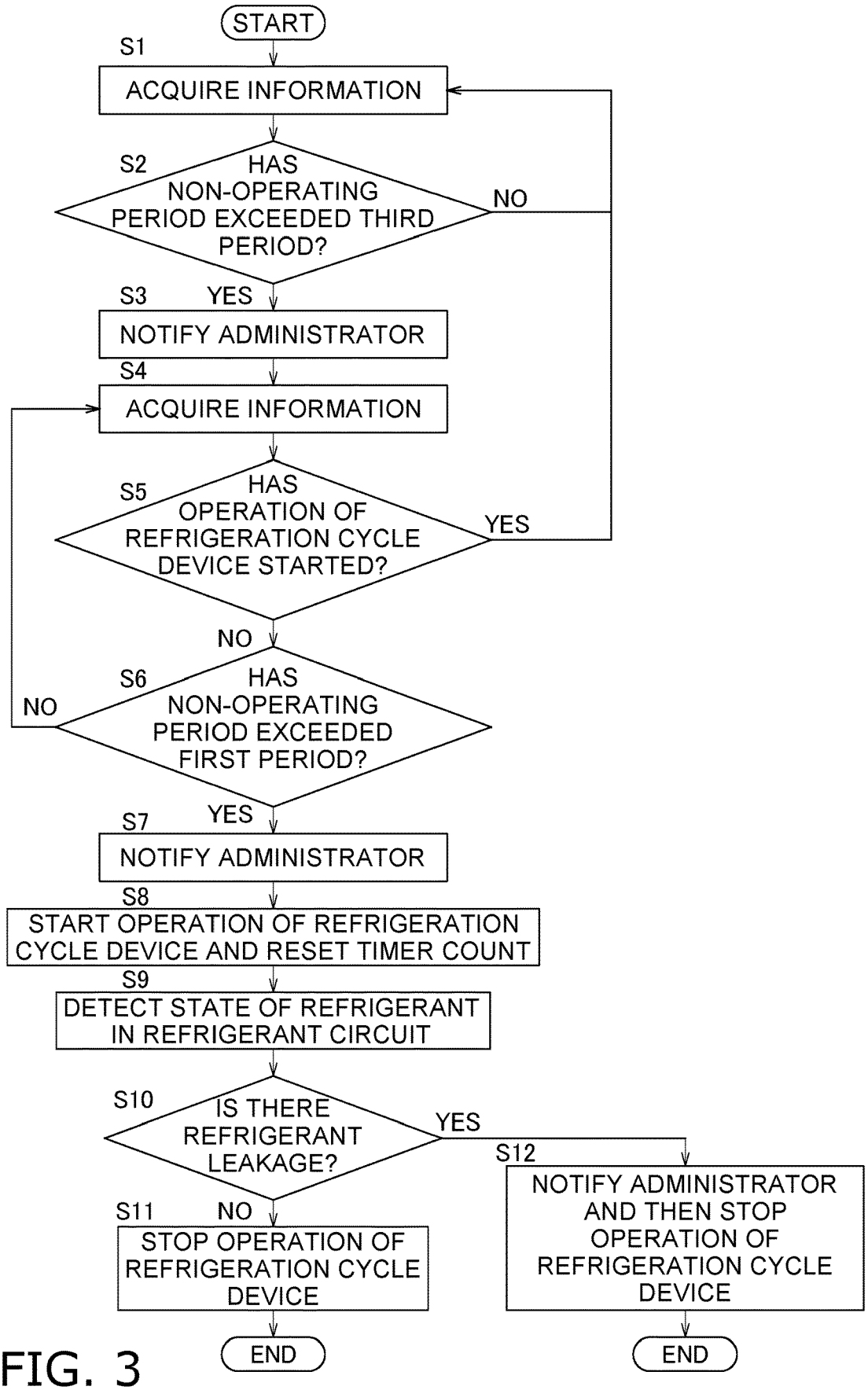
FIG. 3 is a flowchart illustrating processing performed by the control unit.

The flow of processing performed by the control unit 100 will be briefly described with reference to FIG. 3. Note that the processing flow illustrated in FIG. 3 is an example, and can be changed as appropriate. For example, as long as there is no inconsistency, the order of the steps may be changed, some of the steps may be executed in parallel with other steps, or other steps may be newly added.

As illustrated in FIG. 3, in step S1, the control unit 100 acquires information (in FIG. 3, simply described as the "information") relating to the non-operating period of the refrigeration cycle device 10.

In step S2, the control unit 100 determines whether or not the non-operating period of the refrigeration cycle device 10 exceeds the third period. If the non-operating period of the refrigeration cycle device 10 has exceeded the third period (Yes in step S2), the processing of the control unit 100 proceeds to step S3. Otherwise (No in step S2), the processing of control unit 100 returns to step S1.

In step S3, the control unit 100 notifies the administrator of the refrigeration cycle device 10.

In step S4, the control unit 100 acquires information relating to the power on/off of the refrigeration cycle device 10 and information relating to the non-operating period of the refrigeration cycle device 10 counted by the timer 20 (in FIG. 3, simply described as "information").

In step S5, the control unit 100 confirms whether or not the operation of the refrigeration cycle device 10 has been started. If the operation of the refrigeration cycle device 10 has been started (Yes in step S5), the count of the timer 20 is reset, and then the processing of the control unit 100 returns to step S1. Otherwise (No in step S5), the processing of the control unit 100 proceeds to step S6.

In step S6, the control unit 100 determines whether or not the non-operating period of the refrigeration cycle device 10 exceeds the first period. If the non-operating period of the refrigeration cycle device 10 exceeds the first period (Yes in step S6), the processing of the control unit 100 proceeds to step S7. Otherwise (No in step S6), the processing of control unit 100 returns to step S4.

In step S7, the control unit 100 notifies the administrator of the refrigeration cycle device 10. If the predetermined time has elapsed after the notification, the processing of the control unit 100 proceeds to step S8.

In step S8, the control unit 100 starts the operation of the refrigeration cycle device 10. In addition, in step S8, the count by the timer 20 is reset.

In step S9, the detection unit 12 detects the state of the refrigerant in the refrigerant circuit 11 of the refrigeration cycle device 10 that is in operation.

In step S10, the control unit 100 determines the presence or absence of refrigerant leakage in the refrigerant circuit 11. If it is determined that there is no refrigerant leak (No in step S10), the processing of the control unit 100 proceeds to step S11. Otherwise (Yes in step S10), the processing of the control unit 100 proceeds to step S12.

In step S11, the control unit 100 stops the operation of the refrigeration cycle device 10.

In step S12, the control unit 100 notifies the administrator that a refrigerant leak has occurred, and then stops the operation of the refrigeration cycle device 10.

(4) Features (4-1)

It is difficult to confirm the presence or absence of refrigerant leakage if the refrigeration cycle device is in a non-operating state for a long term.

The refrigerant leakage management system 1 according to the present embodiment includes the timer 20 and the control unit 100. The timer 20 counts the non-operating period of the refrigeration cycle device 10. The control unit 100 determines whether or not the non-operating period of the refrigeration cycle device 10 exceeds a predetermined first period. Upon determining that the non-operating period of the refrigeration cycle device 10 exceeds the first period, the control unit 100 brings the refrigeration cycle device 10 into operation.

The refrigerant leakage management system 1 according to the present embodiment allows the refrigeration cycle device 10 to be operated periodically. This configuration prevents the refrigeration cycle device 10 from being in a non-operating state for a long term. Therefore, it is possible to periodically acquire data of the refrigeration cycle device 10 during operation. Thus, the presence or absence of refrigerant leakage can be confirmed periodically.

(4-2)

In the refrigerant leakage management system 1 according to the present embodiment, the first period is shorter than a second period. The second period is defined by a rule. During the second period, inspection of the refrigeration cycle device 10 by a method other than manual inspection is allowed.

Various rules are provided for the inspection of the refrigeration cycle device. The rules may include a rule that requires manual inspection of the refrigeration cycle device in a case where the refrigeration cycle device is in a non-operating state for a predetermined period or more.

The refrigerant leakage management system 1 according to the present embodiment can bring the refrigeration cycle device 10 into operation before the second period, which is the period defined by the rule, has elapsed. This prevents the non-operating period of the refrigeration cycle device 10 from exceeding the second period. Therefore, the inspection of the refrigeration cycle device 10 can be continued by a method other than manual inspection.

(4-3)

In the refrigerant leakage management system 1 according to the present embodiment, the control unit 100 notifies the administrator that the refrigeration cycle device 10 needs to be manually inspected if the non-operating period of the refrigeration cycle device 10 exceeds the second period.

The refrigerant leakage management system 1 according to the present embodiment can prompt the administrator to operate the refrigeration cycle device 10 before the second period has elapsed. Therefore, the operation of the refrigeration cycle device 10 can be expected to start before the second period has elapsed.

(4-4)

In the refrigerant leakage management system 1 according to the present embodiment, upon detecting that the refrigeration cycle device 10 has been operated before the second period elapses, the control unit 100 resets the count of the timer 20.

With this configuration, the non-operating period of the refrigeration cycle device 10 is accurately counted.

(4-5)

In the refrigerant leakage management system 1 according to the present embodiment, upon determining that the non-operating period of the refrigeration cycle device 10 exceeds a third period, the control unit 100 notifies the administrator of the refrigeration cycle device 10. The third period is shorter than the first period.

With this configuration, the operation of the refrigeration cycle device 10 can be expected to start before the second period has elapsed.

(4-6)

The refrigerant leakage management system 1 according to the present embodiment further includes the detection unit 12. The detection unit 12 detects the state of the refrigerant in the refrigerant circuit 11 of the refrigeration cycle device 10. The control unit 100 determines the presence or absence of refrigerant leakage from the refrigerant circuit 11 on the basis of the detection result of the detection unit 12.

With this configuration, the control unit 100 can detect refrigerant leakage in the refrigerant circuit 11.

(5) Modifications

Modifications of the above embodiment will be described below. The following modifications may be combined as appropriate, as long as there is no inconsistency. Note that configurations similar to those in the above embodiment are denoted with similar reference signs, and the detailed description thereof will be omitted.

(5-1) Modification 1A

In the above embodiment, an example has been described in which the control unit 100 brings the refrigeration cycle device 10 into operation when the non-operating period of the refrigeration cycle device 10 exceeds the first period. However, the mode of control by the control unit 100 is not limited thereto.

In the refrigerant leakage management system 1 according to the present modification, when the non-operating period of the refrigeration cycle device 10 exceeds the first period, the control unit 100 notifies the administrator. Specifically, the control unit 100 transmits, to a terminal or the like owned by the administrator, a message indicating that the non-operating period of the refrigeration cycle device 10 has exceeded the first period. At this time, preferably, the control unit 100 simultaneously transmits a message indicating that the refrigeration cycle device 10 needs to be manually inspected if the non-operating period of the refrigeration cycle device 10 exceeds the second period.

The refrigerant leakage management system 1 according to the present modification can prompt the administrator to operate the refrigeration cycle device 10. By notifying the administrator that the refrigeration cycle device 10 has not been operated for a predetermined period or more, it is possible to prompt the administrator to operate the refrigeration cycle device 10. This prevents the refrigeration cycle device 10 from being in anon-operating state for a long term.

It is possible to prompt the administrator to operate the refrigeration cycle device 10 before the second period, which is the period defined by the rule, has elapsed. This prevents the non-operating period of the refrigeration cycle device 10 from exceeding the second period.

(5-2) Modification 1B

In the above embodiment, the example in which the settings for the first period, the second period, and the third period are stored in advance in the storage unit 40 has been described. However, the information stored in the storage unit 40 is not limited thereto, and for example, a setting for a fourth period may be stored. The fourth period is longer than the third period and shorter than the first period. Specifically, the fourth period is due three days before the first period.

In the refrigerant leakage management system 1 according to the present modification, when the non-operating period of the refrigeration cycle device 10 exceeds the fourth period, the control unit 100 notifies the administrator, for example. Specifically, the control unit 100 transmits, to a terminal or the like owned by the administrator, a message indicating that the non-operating period of the refrigeration cycle device 10 has exceeded the fourth period.

In the refrigerant leakage management system 1 according to the present modification, the operation of the refrigeration cycle device 10 can be expected to start.

(5-3) Modification 1C

Although not described in the above embodiment, the count of the timer 20 can be reset even when the refrigeration cycle device 10 is manually inspected.

(5-4) Modification 1D

In the above embodiment, an example of the rule that defines the second period as three months has been described. However, the above rule is merely an example, and the rule can be appropriately changed depending on the area or period in which the refrigerant leakage management system according to the present disclosure is used. Therefore, the settings for the first period, the second period, and the third period can also be changed as appropriate.

(5-5) Modification 1E

In the above embodiment, an example has been described in which the control unit 100 causes the refrigeration cycle device 10 to operate for about 5 minutes if the non-operating period of the refrigeration cycle device 10 exceeds the first period. However, the mode of control of the refrigeration cycle device 10 by the control unit 100 is not limited thereto.

In the refrigerant leakage management system 1 according to the present modification, the control unit 100 causes the refrigeration cycle device 10 to operate for about 30 minutes, for example. This configuration increases the amount of information acquired by the detection unit 12. Therefore, the accuracy of refrigerant leakage detection is improved.

(5-6) Modification 1F

Figure 4:
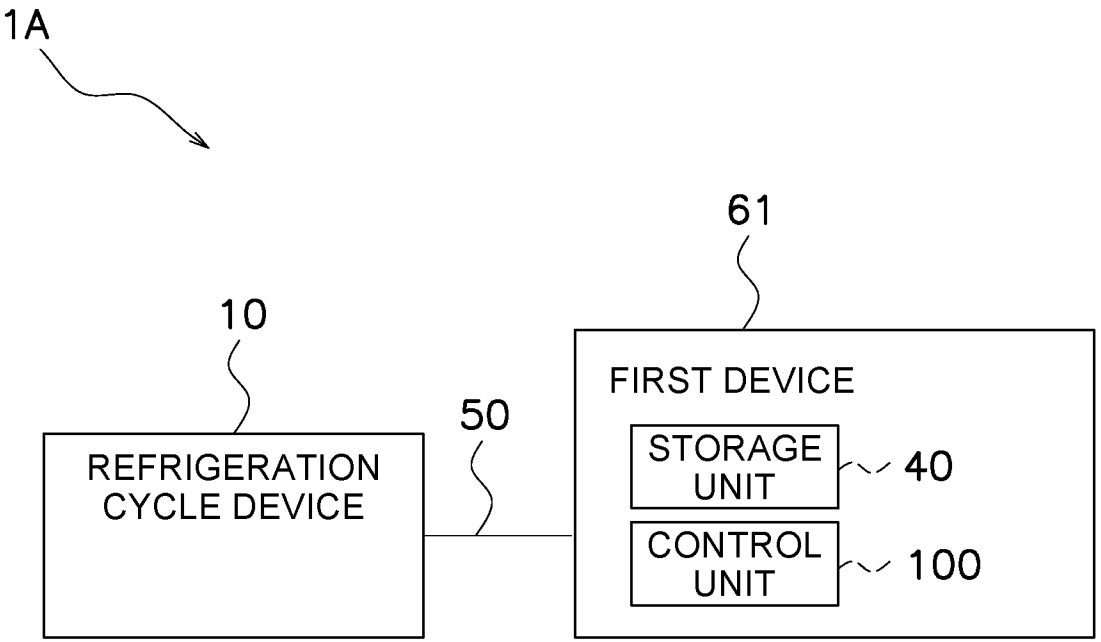
FIG. 4 is a schematic diagram illustrating the configuration of a refrigerant leakage management system according to Modification 1F.

In the above embodiment, the refrigeration cycle device 10 serving as an example of the refrigerant leakage management system 1 has been described. However, the configuration of the refrigerant leakage management system is not limited thereto. For example, the refrigerant leakage management system may be a refrigerant leakage management system 1A including the refrigeration cycle device 10 and the first device 61 (see FIG. 4). The first device 61 has the function of intensively managing the refrigeration cycle device 10 on the basis of the operation data of the refrigeration cycle device 10 acquired via a communication line 50. The first device 61 is, for example, a local controller.

In the refrigerant leakage management system 1A, the storage unit 40 and the control unit 100 are included in the first device 61. In addition, in the refrigerant leakage management system 1A, the outdoor unit (not illustrated) of the refrigeration cycle device 10 has a control device (not illustrated) that controls the operation of various equipment constituting the outdoor unit.

The configuration according to the present modification also achieves functional effects similar to those of the configuration according to the above embodiment.

(5-7) Modification 1G

Figure 5:
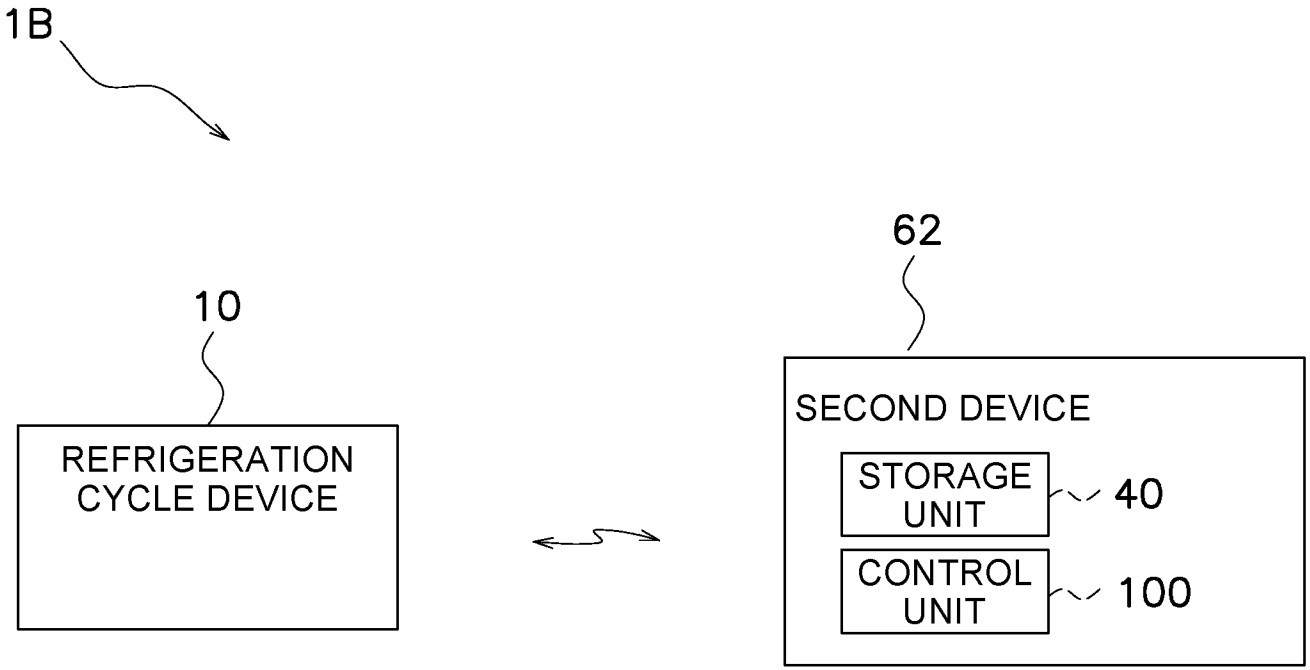
FIG. 5 is a schematic diagram illustrating the configuration of a refrigerant leakage management system according to Modification 1G.

In the above embodiment, the refrigeration cycle device 10 serving as an example of the refrigerant leakage management system 1 has been described. However, the configuration of the refrigerant leakage management system is not limited thereto. For example, the refrigerant leakage management system may be a refrigerant leakage management system 1B including the refrigeration cycle device 10 and a second device 62 (see FIG. 5). The second device 62 has the function of managing the refrigeration cycle device 10 by communicating with the refrigeration cycle device 10 from a building different from the building in which the refrigeration cycle device 10 is installed. The second device 62 is, for example, a server.

In the refrigerant leakage management system 1B, the storage unit 40 and the control unit 100 are included in the second device 62. In addition, in the refrigerant leakage management system 1B, the outdoor unit (not illustrated) of the refrigeration cycle device 10 has a control device (not illustrated) that controls the operation of various equipment constituting the outdoor unit.

The configuration according to the present modification also achieves functional effects similar to those of the configuration according to the above embodiment.

(5-8) Modification 1H

In the above embodiment, an example has been described in which the control unit 100 causes the refrigeration cycle device 10 to operate in the cooling operation mode if the non-operating period of the refrigeration cycle device 10 exceeds the first period. However, the mode of control by the control unit 100 is not limited thereto.

For example, the control unit 100 may cause the refrigeration cycle device 10 to operate in a heating operation mode if the non-operating period of the refrigeration cycle device 10 exceeds the first period. The control unit 100 may also cause the refrigeration cycle device 10 to operate in the operation mode set during the previous operation. Alternatively, if an administrator or user of the refrigeration cycle device 10 sets the operation mode of the refrigeration cycle device 10 through a remote controller after the control unit 100 causes the refrigeration cycle device 10 to operate in the cooling operation mode or the heating operation mode, the control unit 100 may switch to the operation in the selected operation mode.

Alternatively, the operation mode executed by the control unit 100 in a case where the non-operating period of the refrigeration cycle device 10 exceeds the first period may be set in advance by an administrator or user of the refrigeration cycle device 10.

<Other Embodiments>

While the embodiments according to the present disclosure have been described above, it will be understood that various changes in forms and details can be made without departing from the spirit and scope of the claims.

The present disclosure is not limited to the exact embodiments described above. The present disclosure can be embodied by modifying the constituent elements in the implementation stage without departing from the gist thereof. The present disclosure can also form various disclosures by appropriately combining the plurality of constituent elements disclosed in each of the above embodiments. For example, some constituent elements may be eliminated from all constituent elements disclosed in the embodiments. Further, the constituent elements may be combined as appropriate in different embodiments. Therefore, the present embodiments should be considered in all respects merely as examples and not as limiting, and are intended to include any modifications obvious to a person skilled in the art.

REFERENCE SIGNS LIST

1, 1A, 1B: refrigerant leakage management system
10: refrigeration cycle device
11: refrigerant circuit
12: detection unit
20: timer
100: control unit

CITATION LIST

Patent Literature

Patent Literature 1: JP 2021-055956 A

The invention claimed is:

1. A refrigerant leakage management system comprising:

a timer that counts a non-operating period of a refrigeration cycle device; and a controller that determines whether or not the non-operating period of the refrigeration cycle device exceeds a predetermined first period, wherein upon determining that the non-operating period of the refrigeration cycle device exceeds the first period, the controller notifies an administrator of the refrigeration cycle device that the refrigeration cycle device will be forcibly operated.

2. The refrigerant leakage management system according to claim 1, wherein the first period is shorter than a second period defined by a rule, and during the second period, inspection of the refrigeration cycle device by a method other than manual inspection is allowed.

3. The refrigerant leakage management system according to claim 2, wherein the controller notifies the administrator that the refrigeration cycle device needs to be manually inspected if the non-operating period of the refrigeration cycle device exceeds the second period.

4. The refrigerant leakage management system according to claim 2, wherein upon detecting that the refrigeration cycle device has been operated before the second period elapses, the controller resets the count of the timer.

5. The refrigerant leakage management system according to claim 1, wherein upon determining that the non-operating period of the refrigeration cycle device exceeds a third period that is shorter than the first period, the controller notifies the administrator of the refrigeration cycle device.

6. The refrigerant leakage management system according to claim 1, further comprising a detector that detects a state of refrigerant in a refrigerant circuit of the refrigeration cycle device, wherein the controller determines presence or absence of refrigerant leakage from the refrigerant circuit on the basis of a detection result of the detector.

7. The refrigerant leakage management system according to claim 3, wherein upon detecting that the refrigeration cycle device has been operated before the second period elapses, the controller resets the count of the timer.

8. The refrigerant leakage management system according to claim 2, wherein upon determining that the non-operating period of the refrigeration cycle device exceeds a third period that is shorter than the first period, the controller notifies the administrator of the refrigeration cycle device.

9. The refrigerant leakage management system according to claim 3, wherein upon determining that the non-operating period of the refrigeration cycle device exceeds a third period that is shorter than the first period, the controller notifies the administrator of the refrigeration cycle device.

10. The refrigerant leakage management system according to claim 4, wherein upon determining that the non-operating period of the refrigeration cycle device exceeds a third period that is shorter than the first period, the controller notifies the administrator of the refrigeration cycle device.

11. The refrigerant leakage management system according to claim 2, further comprising a detector that detects a state of refrigerant in a refrigerant circuit of the refrigeration cycle device, wherein the controller determines presence or absence of refrigerant leakage from the refrigerant circuit on the basis of a detection result of the detector.

12. The refrigerant leakage management system according to claim 3, further comprising a detector that detects a state of refrigerant in a refrigerant circuit of the refrigeration cycle device, wherein the controller determines presence or absence of refrigerant leakage from the refrigerant circuit on the basis of a detection result of the detector.

13. The refrigerant leakage management system according to claim 4, further comprising a detector that detects a state of refrigerant in a refrigerant circuit of the refrigeration cycle device, wherein the controller determines presence or absence of refrigerant leakage from the refrigerant circuit on the basis of a detection result of the detector.

14. The refrigerant leakage management system according to claim 5, further comprising a detector that detects a state of refrigerant in a refrigerant circuit of the refrigeration cycle device, wherein the controller determines presence or absence of refrigerant leakage from the refrigerant circuit on the basis of a detection result of the detector.

15. The refrigerant leakage management system according to claim 1, further comprising a detector that detects a state of refrigerant in a refrigerant circuit of the refrigeration cycle device that is in operation, wherein the controller determines presence or absence of refrigerant leakage from the refrigerant circuit on the basis of a detection result of the detector.

16. The refrigerant leakage management system according to claim 1, wherein if a predetermined time has elapsed after the notification, the control unit brings the refrigeration cycle device into operation.

* * * * *